United States Patent [19]

Brenez

[11] 3,985,299

[45] Oct. 12, 1976

[54] SPRAY HEAD

[75] Inventor: Jean Brenez, Pessac, France

[73] Assignee: Societe des Plastiques BRENEZ, France

[22] Filed: June 12, 1975

[21] Appl. No.: 586,303

[30] Foreign Application Priority Data

Nov. 29, 1974 France ..... 74.41060

[52] U.S. Cl. ..... 239/119; 239/311; 239/327; 239/356; 239/357; 222/108; 222/193

[51] Int. Cl.[2] ..... B05B 15/02; B05B 7/26

[58] Field of Search ..... 239/310, 311, 327, 328, 239/323, 357, 355, 119, 356; 222/193, 108

[56] References Cited

UNITED STATES PATENTS

| | | | |
|---|---|---|---|
| 2,079,587 | 5/1937 | Aronson | 239/357 X |
| 2,409,987 | 10/1946 | Schroeder et al. | 239/357 |
| 2,758,879 | 8/1956 | Anderson | 239/356 X |
| 3,367,330 | 2/1968 | Sierpin | 239/327 X |
| 3,491,918 | 1/1970 | Lucas | 222/193 |
| 3,794,247 | 2/1974 | Corsette | 239/327 |

FOREIGN PATENTS OR APPLICATIONS

| | | | |
|---|---|---|---|
| 1,550,307 | 11/1968 | France | 239/327 |
| 680,855 | 10/1952 | United Kingdom | 239/356 |

*Primary Examiner*—Robert S. Ward, Jr.
*Attorney, Agent, or Firm*—Marn & Jangarathis

[57] ABSTRACT

This present invention relates to a spray head for spray diffusers of liquids, powders, and the like. This spray head consists of three separable parts mounted together to form an air-admission chamber between them. The head has an internal groove for collecting traces of the spray products after each spraying operation, such that the product does not flow down the side of the head and the diffuser to render the diffuser inoperative.

8 Claims, 1 Drawing Figure

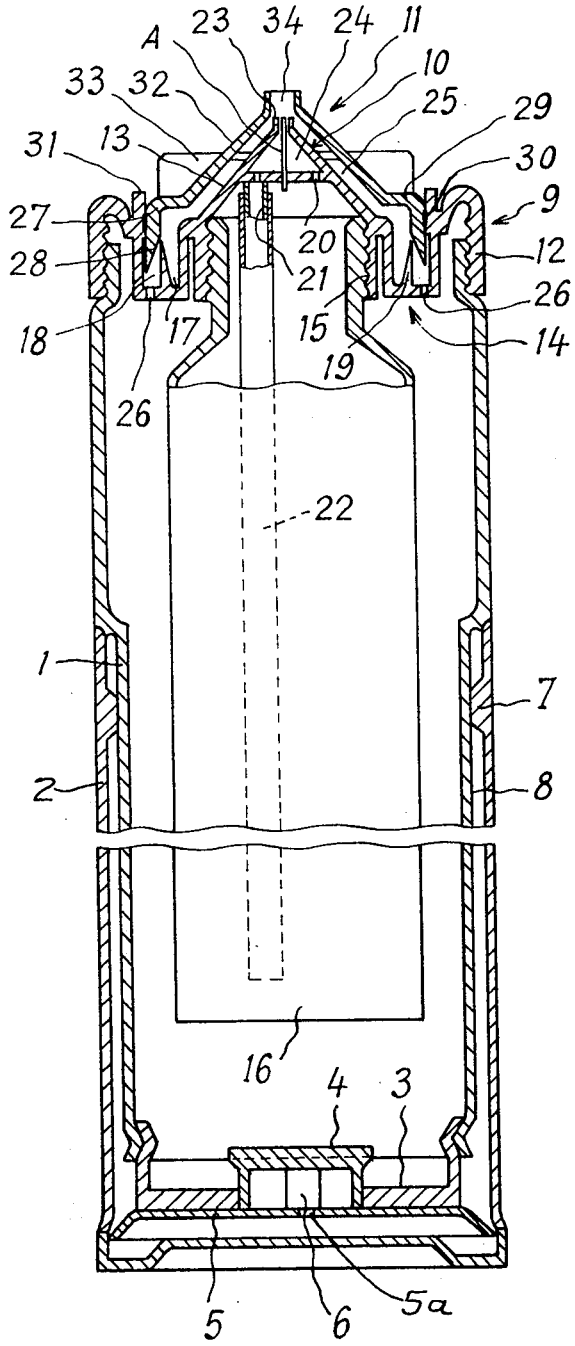
A
23
34
24
11
10
33
32
25
29
31
13
30
27
9
20
28
12
21
26
18
17
15
14
19
26
22
1
7
2
8
16
4
3
5
6
5a

SPRAY HEAD

This invention relates to spray heads for material such as liquid, powders, and the like and, more particularly, to a head for spraying such material which may be absorbed by the material of the spray head of an atomizer or an aerosol container.

Spray heads are well known and used widely in various types of spray diffusers. One type of such spray heads consists of a first part threadingly mounted to the end of a tube and comprising, at its centre a frusto-conical portion having a small base pierced by two holes in which one of the holes is fitted with a union and is extended by an internal skirt adapted for mounting engagement with the neck of a bottle which serves as the liquid reservoir. A tube is mounted on the union and extends into the reservoir. A second conical part is mounted on the small base of the first part and comprising an axial passage communicating with a groove in its base acting as a collector for the two holes in the small base. A third conical part is mounted on the first part and surrounding the frusto-conical portion surmounted by the second part and having a spraying aperture at its tip. The space between this part and the other two parts forms an air-inlet chamber. One or more holes are arranged in the first part so as to allow the chamber to communicate with the interior of the tube. Such spray head operates satisfactorily when it is used for spraying products which would not be absorbed by the material making the spray head.

On the other hand, if the products to be sprayed can be absorbed by, or reacts with, the material of the spray head, the latter would swell and may thus render the spray diffuser inoperative. For example, when a liquid and, more particularly, a petroleum product is being sprayed, the bottle made of a flexible material and constituting a reservoir for the liquid being sprayed, does not return instantaneously to its position of equilibrium after the first spraying operation. This is due to the well-known phenomenon of remanence. The last few drops of the first spray are not discharged from the spray diffuser and are usually remaining in the spray head. These remanent drops trickle down the walls of the head to the body of the spray diffuser. They often fall to and accummulate in the bottom of the spray diffuser. More often, they remain on the walls of the body and are absorbed thereby or pervade thereinto. This causes the head to swell such that it is not operative.

It is the principal object of the present invention to mitigate the above-mentioned disadvantages, and to provide a spray head which may be adapted to any type of spray diffuser, regardless of the material of which it is made, so that the spray head can be used to spray any liquid or powder products.

The spray head of the present invention broadly comprises a first part adapted to be attached to the body of the spray diffuser and having, at its centre, a frusto-conical portion. The small base of the frusto-conical portion has two orifices. One of the orifices is provided with a union which is extended by an internal skirt on, or in, which is located in the neck of a bottle which serves as a reservoir for the product. A tube is mounted on the union and extends into the bottle. A second conical part is mounted on the small base of the frusto-conical portion and it comprises an axial passage. A third conical part is mounted on the first part and it surrounds the frusto-conical portion which is surmounted by the second part. The tip of this third part is provided with a spraying aperture. The space between this third part and the other two parts form an air-inlet chamber into which air may enter through one or more orifices provided in the first part, so that the air-inlet chamber is allowed to communicate with the interior of the spray diffuser. The internal skirt of the first part is provided with at least one annular groove communicating with the air-inlet chamber and comprising a wall which is at least partly flexible and is capable of shutting off the communication between the orifice, or orifices, arranged in the first part and the air-inlet chamber.

Another feature of the invention is that the flexible wall rests upon an internal skirt arranged in the third part. During the remanence of the product reservoir, which corresponds to a depression, this makes it possible to apply the flexible wall to the internal skirt of the third part so as to ensure isolation between the air-inlet chamber and the interior of the spray diffuser.

Furthermore, the internal skirt of the third part has a portion which is bevelled in order to direct the droplets to trickle along the internal skirt towards the annular groove.

In the spray head of the present invention a pin is mounted at the centre of the small base of the first part. The pin is located partly within the axial passage in the second part so as to define an annular space for the passage of the product to be sprayed. Such structure provides a high efficiency in the spraying operation.

Other advantages and characteristics of the invention appear in the description, given below by way of example but not to be regarded as restrictive, of a preferred example of embodiment of the invention, and in the drawing attached hereto, which shows a cross-section of a spray diffuser equipped with a spray head according to the invention. The invention will be more clearly understood by reference to the following detailed descripton of an exemplary embodiment thereof in conjunction with the accompanying drawing of elevational an elevational cross-sectional view thereof.

Referring to the drawing, the spray diffuser equipped with the spray head, according to the invention, consists of an internal tube 1 slidably mounted at one end in an external tube 2. The two tubes may be slidably movable relative to each other to act as an air-compression pump. A valve seat 3 is mounted in the lower part of tube 1 and it has a valve 4. A piston 5 is provided at the base of the valve seat 3. The piston is connected to the valve 4 by fingers 6 and is provided with a central bore 5*a*.

Lugs 7 are provided on the inside walls of tube 2. These lugs are slidably engaged with longitudinal grooves 8 formed on the outside wall of tube 1. The internal tube 1 may also be provided with guide projections (not shown).

The spray head according to the invention has three parts generally shown by numerals 9, 10, 11. The periphery of first part 9 is threadingly mounted to the open end of tube 1 such that the entire spray head may be removed from the diffuser, if required. The first part 9 comprises, at its centre, a frusto-conical portion 13 having a large base extending internally towards tube 1 in the form of a skirt generally shown by the numeral 14. The skirt 14 has internal threads 15 which threadingly engage with the end of a bottle 16 which serves as the reservoir for the product to be sprayed. The internal skirt 14 has two annular grooves 17, 18 separated by a wall 19. The upper portion of the wall 19 is at least partly flexible. Two holes 20 are formed in the small base of this portion 13. One of the holes 20 has a union 21 for mounting engagement with a tube 22 which extends into the bottle 16 such that this hole 20 is in 34 through which the compressed air, formed by sliding tubes 1 and 2, relative to each other, escapes after passing through orifices 26 and chamber 25.

In operation, the housing is extended by moving tubes 1 and 2 outwards. Valve 4 will bear against the seat 3 such that air is drawn through the gap between tube 1 and tube 2 to fill the cavity between the seat 3 and the bottom of the outer tube 2. The housing is then compressed by moving the tubes 1 and 2 quickly towards each other such that the air in the housing is compressed and such compressed air will lift valve 4. The piston 5 will bear against the lower edges of the tube 1 so that the air will pass between fingers 6 and to fill the interior of tube 1. This compressed air acts upon the walls of the reservoir and forces the product in the reservoir to rise in tube 22 and to pass through orifice 20 into space 24, whence it is discharged in the form of a hollow jet defined by the walls of the axial passage 23 and pin A.

Upon emerging from the axial passage 23, the hollow jet is subjected to the pressure of the air arriving from orifices 26. The diameters of the orifices 26 are such that they produce a flow of air capable of atomizing the hollow jet of the product. The air pressure also deforms the annular wall 19 and will cause it to bear against the fixed wall of the groove 17. The atomized spray may be further improved by selecting an appropriate ratio between the cross-sections of the discharge orifice 34 and the axial passage 23. Typically, the inside diameter of the discharge orifice may be about 4.2 mm, while the outside diameter of axial passage 23 may be about 3 mm.

After the product has been sprayed and the pressure ceases, the walls of the reservoir 16 return to their initial relaxed position of equilibrium. A depression is created in this stage in which the flexible wall 19 bears against the internal skirt 27 of the third part 11. More particularly, it bears against the bevelled inside edge portion 28, thus eliminating all communication between the air-inlet chamber 25 and the inside of internal tube 1.

Any droplets of the product flowing down the walls of the three parts constituting the head would accumulate in the groove 17 and such droplets are thus prevented from coming into contact with the internal walls of tubes 1 and 2 constituting the body of the spray diffuser. In order to ascertain that the droplets will accumulate in groove 17, the thickness of the flexible wall is reduced from the base towards the free edge thereof. The outside diameter of the flexible wall is made equal to the inside diameter of the skirt 27 at the height at which the bevelled edge portion 28 is formed.

It is to be understood that this present invention is not restricted to the form of the embodiment described above, but also covers any obvious variants thereof. Furthermore, the spray head according to the invention may be adapted to other types of spray diffuser.

The embodiment of the invention in which an exclusive property or privilege is claimed are defined as follows:

1. A spray head for an atomization diffuser comprising a first part adapted to be mounted to said spray diffuser and having at its centre a frusto-conical portion, said frusto-conical portion having a small base provided with two orifices, one of said orifices having equipped with a union, said frusto-conical portion having an internal skirt threadingly engageable with a neck of a bottle serving as a reservoir for a product to be sprayed, a tube mounted on said union and extending into said bottle; a second conical part mounted on said small base of said frusto-conical portion and having an axial passage; and a third conical part mounted on said first part and surrounding said frusto-conical portion which is surmounted by said second part, said third part having a tip provided with a spraying aperture, said third part being spaced from said first and second parts forming an air-inlet chamber into which air enters through at least one orifice arranged in said first part and allowing said air-inlet chamber to communicate with the interior of the spray diffuser, said internal skirt on the first part comprising at least one annular groove communicating with said air-inlet chamber and having a wall which is at least partly flexible and is capable of shutting off the communication between said orifice, arranged in said first part and said air-inlet chamber.

2. A spray head according to claim 1, wherein said flexible wall bears against an internal skirt formed in said third part.

3. A spray head according to claim 2, wherein said internal skirt on said third part has a bevelled inside edge portion.

4. A spray head according to claim 3, wherein said internal skirt has inside and outside diameters equal to that of said flexible wall, respectively.

5. A spray head according to claim 4, wherein said flexible wall has a thickness decreasing from its base towards its free edge thereof.

6. A spray head according to claim 1, wherein a pin is mounted at the centre of said small base of the first part, said pin being located partly in said axial passage in said second part, and said pin defining, in the said axial passage, an annular space for the passage of the product to be sprayed.

7. A spray head according to claim 6, wherein said pin is a solid pin.

8. A spray head according to claim 6, wherein said second part is hollow.

* * * * *